United States Patent [19]

Moffitt

[11] Patent Number: 4,786,389

[45] Date of Patent: Nov. 22, 1988

[54] ELECTROPLATING APPARATUS

[75] Inventor: Herb J. Moffitt, Carlisle, Pa.

[73] Assignee: AMP Incorporated, Harrisburg, Pa.

[21] Appl. No.: 101,216

[22] Filed: Sep. 25, 1987

[51] Int. Cl.[4] ..... C25D 17/00

[52] U.S. Cl. ..... 204/206; 204/224 R

[58] Field of Search ..... 204/206, 224 R

[56] References Cited

U.S. PATENT DOCUMENTS

| | | | |
|---|---|---|---|
| 936,472 | 10/1909 | Pfanhauser | 204/206 |
| 2,540,602 | 2/1951 | Thomas et al. | 204/15 |
| 3,637,468 | 1/1972 | Texi et al. | 204/15 |
| 3,661,752 | 5/1972 | Capper et al. | 204/206 |
| 3,691,026 | 9/1972 | Durrwachter et al. | 204/28 |
| 3,751,343 | 8/1973 | Macula et al. | 204/15 |
| 3,904,489 | 9/1975 | Johnson | 204/15 |
| 3,951,772 | 4/1976 | Bick et al. | 204/198 |
| 3,966,581 | 6/1976 | Holte | 204/202 |
| 4,010,083 | 3/1977 | Bakker et al. | 204/15 |
| 4,036,705 | 7/1977 | Eidschun, Jr. | 204/15 |
| 4,048,043 | 9/1977 | Bick et al. | 204/224 |
| 4,064,019 | 12/1977 | Eidschun, Jr. | 204/15 |
| 4,078,982 | 3/1978 | Eidschun, Jr. | 204/224 |
| 4,090,938 | 5/1978 | Eidschun, Jr. | 204/224 |
| 4,119,499 | 10/1978 | Eidschun, Jr. | 204/15 |
| 4,220,504 | 9/1980 | Hanley et al. | 204/15 |
| 4,304,654 | 12/1981 | Norris | 204/212 |
| 4,361,470 | 11/1982 | Eidschun | 204/15 |
| 4,452,684 | 6/1984 | Palnik | 204/206 |
| 4,597,845 | 7/1986 | Bacon et al. | 204/206 |
| 4,655,881 | 4/1987 | Tezuka et al. | 204/15 |
| 4,702,811 | 10/1987 | Murata et al. | 204/206 |

FOREIGN PATENT DOCUMENTS

| | | | |
|---|---|---|---|
| 2010139 | 7/1971 | Fed. Rep. of Germany | 204/206 |
| 1816645 | 10/1973 | Fed. Rep. of Germany | 204/224 R |
| 331930 | 10/1903 | France | 204/224 R |
| 2260635 | 9/1975 | France | 204/224 R |
| 188817 | 12/1966 | U.S.S.R. | 204/224 R |
| 18643 | 9/1899 | United Kingdom | 204/224 R |
| 14091 | 6/1909 | United Kingdom | 204/206 |
| 493108 | 9/1938 | United Kingdom | 204/224 R |
| 760016 | 10/1956 | United Kingdom | 204/206 |
| 1409044 | 10/1975 | United Kingdom | 204/224 R |
| 1508826 | 4/1978 | United Kingdom | 204/206 |
| 1551212 | 8/1979 | United Kingdom | 204/206 |

OTHER PUBLICATIONS

Practical Brush Plating with The Dalic Process, Marv Rubinstein (1956) pp. 1-11.

The Dalic Process of Selective Plating-Brush Plating Now Practical Marvin Rubinstein.

*Primary Examiner*—T. M. Tufariello

*Attorney, Agent, or Firm*—Allan B. Osborne

[57] ABSTRACT

An electroplating cell includes a chamber which defines at least one elongated slot. The chamber is fixedly mounted in place such that the slot extends along a translation axis, along which parts to be plated are moved. An elongated brush is fixedly mounted in the chamber to pass through the slot in order to wick plating solution from the chamber, through the slot, into contact with the parts to be plated. The slot and the brush preferably define a large aspect ratio in order to provide high precision plating of small selected surfaces in combination with high plating rates. Preferably, the brush includes a dielectric strip, an anode strip, and a fabric sleeve which is stitched to the dielectric strip to hold the anode strip in place.

19 Claims, 8 Drawing Sheets

ELECTROPLATING APPARATUS

BACKGROUND OF THE INVENTION

This invention relates to an improved electroplating apparatus of the type which utilizes a brush to apply a plating solution to selected regions of parts being plated.

A variety of electroplating approaches have been used in the past, including immersion or dipping of the parts to be plated in a plating solution, spraying of the plating solution onto the parts, and transporting plating solution to the parts with a tool (often called a brush) which includes an absorbent material positioned to contact the parts. This last approach is generally referred to as brush plating.

A number of early approaches to brush plating used a chamber into which a plating solution was pumped. An absorbent applicator was used to transport the plating solution from the chamber to the part being plated. For example, Snyder British Patent No. 18,643 shows in FIGS. 5–7 devices which use tufts of bristles to transfer plating solution to large surface areas of the parts being plated. Similarly, Thomas U.S. Pat. No. 2,540,602 shows in FIG. 4 an electroplating device which uses a pad of cotton or glass fiber to transfer plating solution from the device to the part, and Icxi U.S. Pat. No. 3,637,468 shows in FIG. 7 a similar device. See also the oscillating chamber and pad of Macula U.S. Pat. No. 3,751,343 (FIG. 2) and the rotating chamber and pad of Norris U.S. Pat. No. 4,304,654 (FIGS. 2 and 3).

Though the devices described in these patents use brush type applicators, none is well suited to the precise application of plating solution only to small, predetermined regions of the parts being plated.

Palnik U.S. Pat. No. 4,452,684 describes another prior art brush plating device which includes a central conduit that defines an array of openings along its length. The conduit is surrounded by an annular tube of a porous, hydrophobic plastic such as polypropylene, which is in turn surrounded by a felt covered platinum screen. The platinum screen is used as the anode in plating operations, and the parts to be plated are guided along the side of a stationary brush in contact with the felt. A plating solution is pumped into the conduit and flows via the openings and the pores in the body, through the screen and into the felt, from which it is transferred to the parts. In the Palnik device the brush is shaped as a generally convex surface which is not well suited for plating small regions of the parts. Because the arrangement of the screen and the felt, a sufficiently large snag or tear in the felt can create a short circuit between the screen and parts to be plated.

Tezuka U.S. Pat. No. 4,655,881 describes another brush plating method which uses a brush made up of an anode covered with a sleeve of an absorbent material such as a non-woven fabric. In one form the brush is dipped into a bath of plating solution and then moved into contact with the part. When the brush becomes depleted of plating solution, it is again dipped into the bath. In another form the brush defines a spiral fin which contacts the part, and the brush is rotated in a bath of plating solution to dip each section of the fin repeatedly into the bath. Both of these approaches require that the brush be moved into and out of the bath in order to continue the plating process. The need to move the brush increases the mechanical complexity of the plating apparatus. As with the Palnik device described above, any tear or snag in the non-woven fabric over the anode creates the potential for an electrical short circuit between the anode and the parts being plated.

The present invention is directed to an improved brush plater and components thereof, which are well suited to high precision plating of small regions of the parts being plated, and which are well adapted for use in a continuous process without requiring movement of the brush.

SUMMARY OF THE INVENTION

According to this invention, an electroplating apparatus for plating only selected regions of parts is provided, which comprises a chamber which defines at least one elongated slot. Means are provided for fixedly mounting the chamber in place such that the slot extends along a translation axis. A plating solution is supplied to the chamber and the plating solution is transported from the chamber, through the slot, to a region external of the chamber by means of an elongated wick which is fixedly mounted to the chamber to pass through the slot. The slot has an aspect ratio as seen from outside the chamber which is preferably greater than 20:1, and is most preferably greater than 100:1. An electrode is mounted alongside the wick, and a plurality of parts to be electroplated are guided for movement along the translation axis past the wick such that plating solution is transferred to the parts by the wick. A voltage differential is created between the electrode and the parts in order to drive the electroplating process.

Also, according to this invention, a plating brush is provided which can be used in the apparatus described above, and which comprises a dielectric strip, an anode strip, and a layer of absorbent fabric positioned around the anode strip and at least part of the dielectric strip.

In use, the electroplating apparatus of this invention provides high precision plating of small surfaces on the parts to be plated. In the preferred embodiment described below the plating solution is continuously supplied to the chamber, and for this reason the electroplating apparatus provides consistent plating results during continuous operation. Because the parts are in contact with the wick over a long path length, extending over the entire length of the slot, relatively high plating rates can be achieved. In particular, the unusually large aspect ratio of the slot and the wick assists in maintaining a high plating rate of only precisely defined, relatively small area regions of the parts. The dielectric strip in the brush reduces problems associated with undesired electrical contact between the parts and the anode strip.

As used in this specification and the following claims, the term "aspect ratio" is intended to refer to the ratio of length to width of the slot or wick as seen from a point outside the chamber in alignment with the slot.

The invention itself, together with further objects and attendant advantages, will best be understood by reference to the following detailed description, taken in conjunction with the accompanying drawings.

DETAILED DESCRIPTION OF THE PRESENTLY PREFERRED EMBODIMENT

Figure 1:
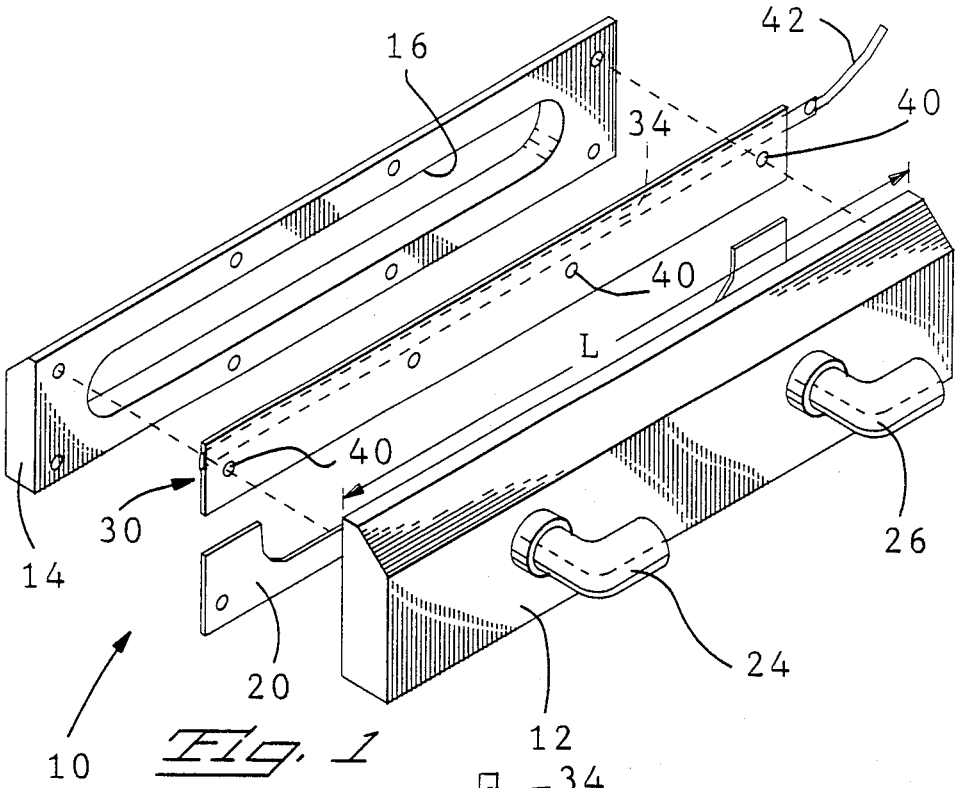
FIG. 1 is an exploded perspective view of an electroplating cell which incorporates a presently preferred embodiment of this invention.
Figure 2:
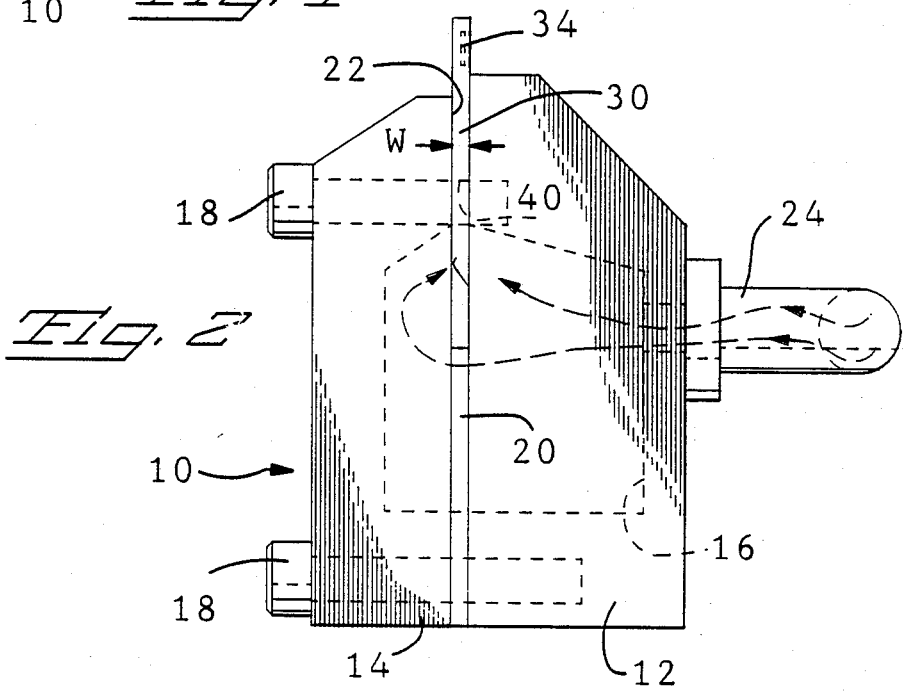
FIG. 2 is an end view of the electroplating cell of FIG. 1.

Turning now to the drawings, FIGS. 1 and 2 show two views of an electroplating cell 10 which incorporates a presently preferred embodiment of this invention. This cell 10 includes means for defining a chamber which is provided with an elongated slot, and means for transporting a plating solution from the chamber through the slot to a region external of the chamber.

In this embodiment, the chamber defining means comprises first and second chamber defining elements 12, 14 which define the chamber 16 therebetween. These chamber defining elements 12, 14 are fastened together by fasteners 18, and a C-shaped seal 20 is interposed between the chamber defining elements 12, 14 so as to seal the chamber 16 on three sides. Of course, it is not essential in all embodiments that the chamber defining means be made up of two separate component elements, and a wide range of alternatives can readily be adapted for use with the present invention, including one piece arrangements and more complicated arrangements having three or more chamber defining elements.

The chamber 16 is exposed to the region outside the cell 10 by means of an elongated slot 22 which preferably extends along the entire length of the cell 10. This slot 22 is positioned directly above the seal 20 when the cell 10 is in the orientation shown in FIG. 2. Of course, it is not essential in all embodiments that the slot 22 extend along the entire length of the cell 10, and in some alternative forms the slot 22 is interrupted at one or more points along the length of the cell 10.

As pointed out above, the chamber 16 is intended to receive a liquid plating solution, and this plating solution is introduced into the chamber 16 via an inlet 24. An outlet 26 allows the plating solution to flow out of the chamber 16. Preferably, the outlet 26 is provided with an orifice to restrict flow out of the chamber 16 and thereby allow the plating solution in the chamber 16 to be pressurized.

Figure 3:
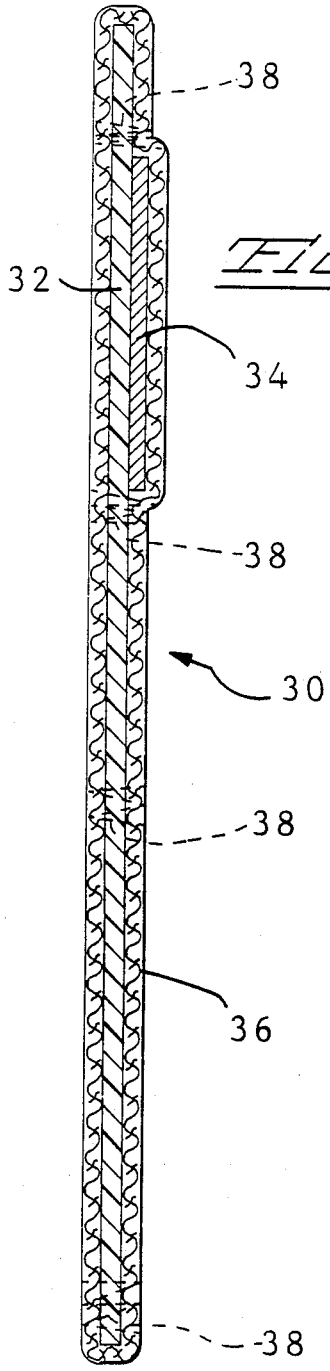
FIG. 3 is a cross sectional view of a brush included in the cell of FIGS. 1 and 2.

In this embodiment the means for transporting the plating solution through the slot comprises a brush 30, best shown in FIGS. 1 and 3. The purpose of the plating solution transport means is to act as an elongated wick which transports plating solution out of the chamber 16 and into contact with the parts to be plated. In this embodiment the brush 30 includes a dielectric strip 32 which is of substantially the same length as the slot 22. An electrode such as an anode 34 is positioned adjacent to the dielectric strip 32, and the assembly of the anode 34 and the dielectric strip 32 is surrounded by a sleeve 36. This sleeve 36 is formed of a hydrophilic, absorbent material which acts as a wick to transport plating solution out of the chamber 16 via the slot 22. As shown in FIG. 3, the sleeve 36 is secured to the dielectric strip 32 by means of rows of stitching 38 in this embodiment. The upper two rows of stitching 38 define a pocket sized to receive the anode 34 and hold it in place against the dielectric strip 32. Important characteristics of the brush 30 include the ability to transport plating solution through the slot 22 and sufficient rigidity to contact the parts being plated in a consistent and reliable manner. Of course, the shape and configuration of the brush 30 can be modified to fit the intended application.

In this embodiment the brush 30 defines an array of openings 40 aligned with respective ones of the fasteners 18. As shown in FIG. 2, the fasteners 18 pass through these openings 40 so as to secure the brush 30 in place in the slot 22 and to prevent the brush 30 from being expelled.

Purely by way of example, the following details of construction are provided in order better to define the best mode of the cell 10. Of course, it should be clearly understood that these details of construction are in no way intended to be limiting. In this embodiment the length of the cell 10 and the slot 22 is 24 inches, the width of the slot 22 is 0.01 inches, and the aspect ratio is 240:1. The dielectric strip 32 is formed of a plastic material such as Mylar (registered trademark), preferably with a thickness of 0.008 inches. The anode 34 is preferably platinum, though alternates such as platinum coated titanium can be used. The anode 34 preferably measures 24 inches in length, 0.25 inches in width, and 0.04 inches in thickness. The sleeve 36 in this embodiment is formed of a woven fabric cotton and nylon such as sold by Seiler and Hughes, of Baltimore, Md., under the tradename SYNEL. Of course, other fabrics including non-woven fabrics can be substituted, as long as they serve the function described above.

Figure 4:
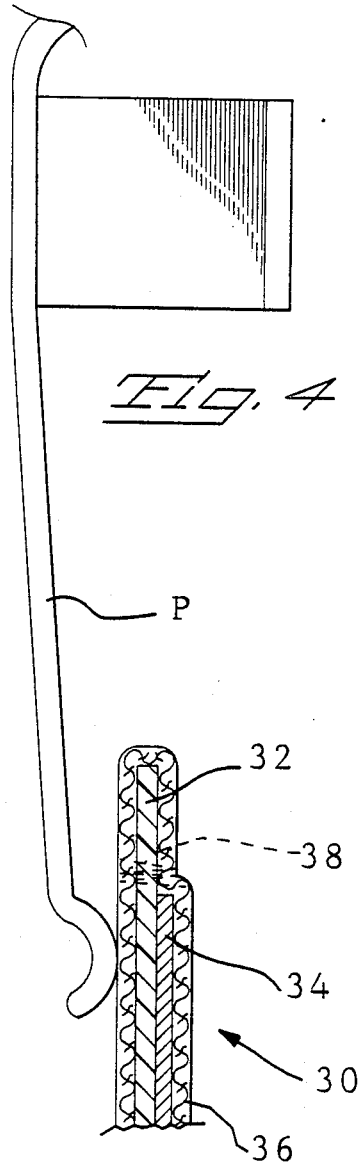
FIG. 4 is partial view of a portion of the brush of FIG. 3 in engagement with a surface of a part being plated.

FIG. 4 shows an enlarged view which depicts in detail the manner in which the end of the brush 30 which extends outside of the slot can contact a part P being plated in order to transfer plating solution onto only precisely defined surfaces of the part P.

Figure 5:
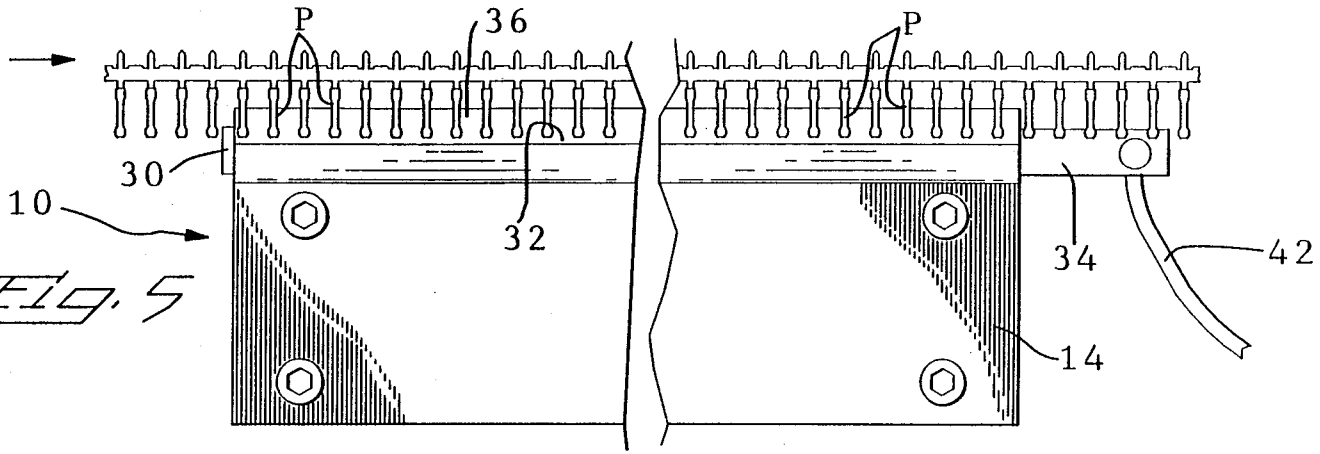
FIG. 5 is a side view of the cell of FIG. 1 in engagement with an array of parts being plated.

FIG. 5 shows a side view of the cell 10 in order further to clarify the manner in which the parts P engage the sleeve 36 of the brush 30. Preferably, both the cell 10 and the brush 30 are fixedly mounted in position and the parts P are guided in translation along a translation axis parallel to the slot 22 so as to move along the length of the brush 30. This arrangement ensures that the parts P are in contact with the brush 30 over a long path length which extends along the full length of the cell 10. In this way, high plating deposition rates can be obtained. In the preferred embodiment described above, the aspect ratio of the slot 22 (defined as the ratio of the length L (FIG. 1) to the width W (FIG. 2) of the slot 22) is quite high. In order to obtain the combined advantages of high precision plating of small surfaces and relatively high plating rates, it is preferable that the aspect ratio of the slot and the brush be greater than 20:1 and most preferably greater than 100:1.

Figure 6:
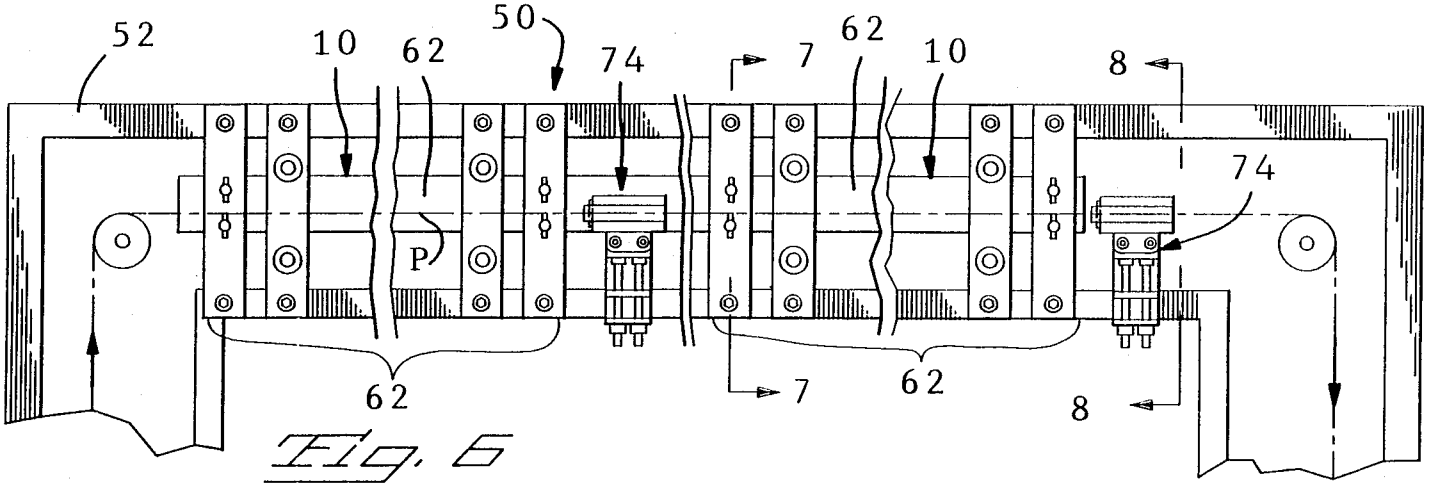
FIG. 6 is a plan view of an electroplating line which includes two of the electroplating cells of FIG. 1.

FIG. 6 shows a plan view of an electroplating apparatus 50 which incorporates two of the electroplating cells 10 described above. This electroplating apparatus 50 includes a trough 52 through which a strip of parts P is moved. In this example the parts P are terminals which, after plating, are separated for use in connectors. These parts P are guided by strip guides 62 in translation along the length of the brush 30 such that the parts P are held in light wiping contact with the sleeve 36 of each of the cells 10.

Figure 7:
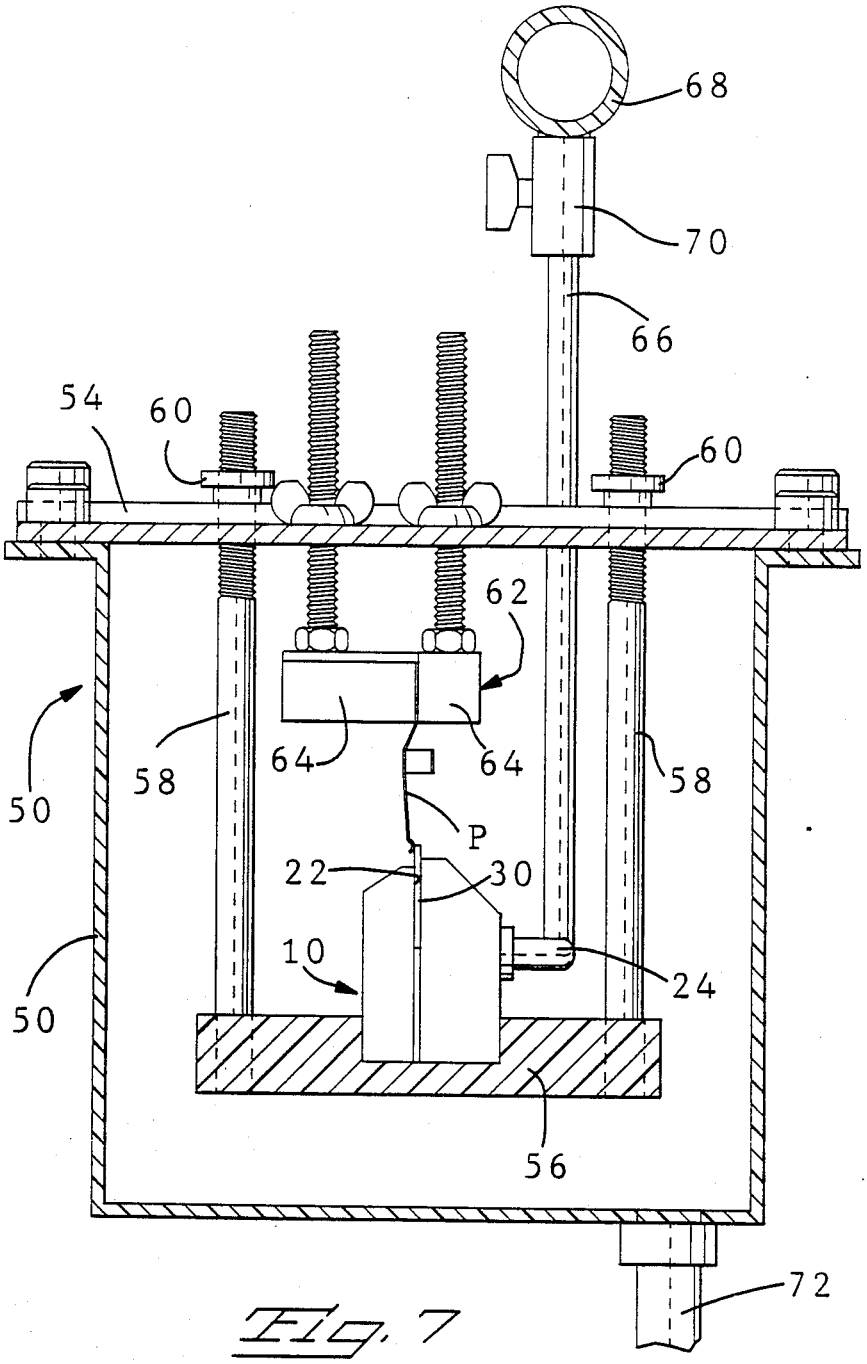
FIG. 7 is a cross sectional view taken along line 7—7 of FIG. 6.

FIG. 7 shows a cross sectional view which clarifies this aspect of the electroplating apparatus 50. As shown in FIG. 7, a cell mounting fixture 54 is mounted directly to the trough 52, and a dielectric support 56 is adjustably positioned under the cell mounting fixture 54 by means of threaded rods 58. These threaded rods 58 are each provided with a nut 60 to allow the dielectric support 56 to be adjusted in height and leveled properly. The dielectric support 56 supports the cell 10 described above.

In addition, the trough 52 supports a strip guide 62 which includes a pair of guide blocks 64 which precisely define the position of the parts P with respect to the cell 10. These guide blocks can be formed of a plastic such as PVC, for example. Plating solution is supplied to the inlet 24 via a feed hose 66 which is connected to a manifold 68 by means of a valve 70. By adjusting the valve 70 the desired pressure of plating solution within the cell 10 can be obtained, thereby achieving the desired flow rate of plating solution out of the chamber via the slot 22. Excess plating solution leaves the chamber via the outlet 26 (not shown in FIG. 7) and is allowed to flow into the trough 52. A drain 72 removes plating solution from the trough 52 for reuse.

Figure 8:
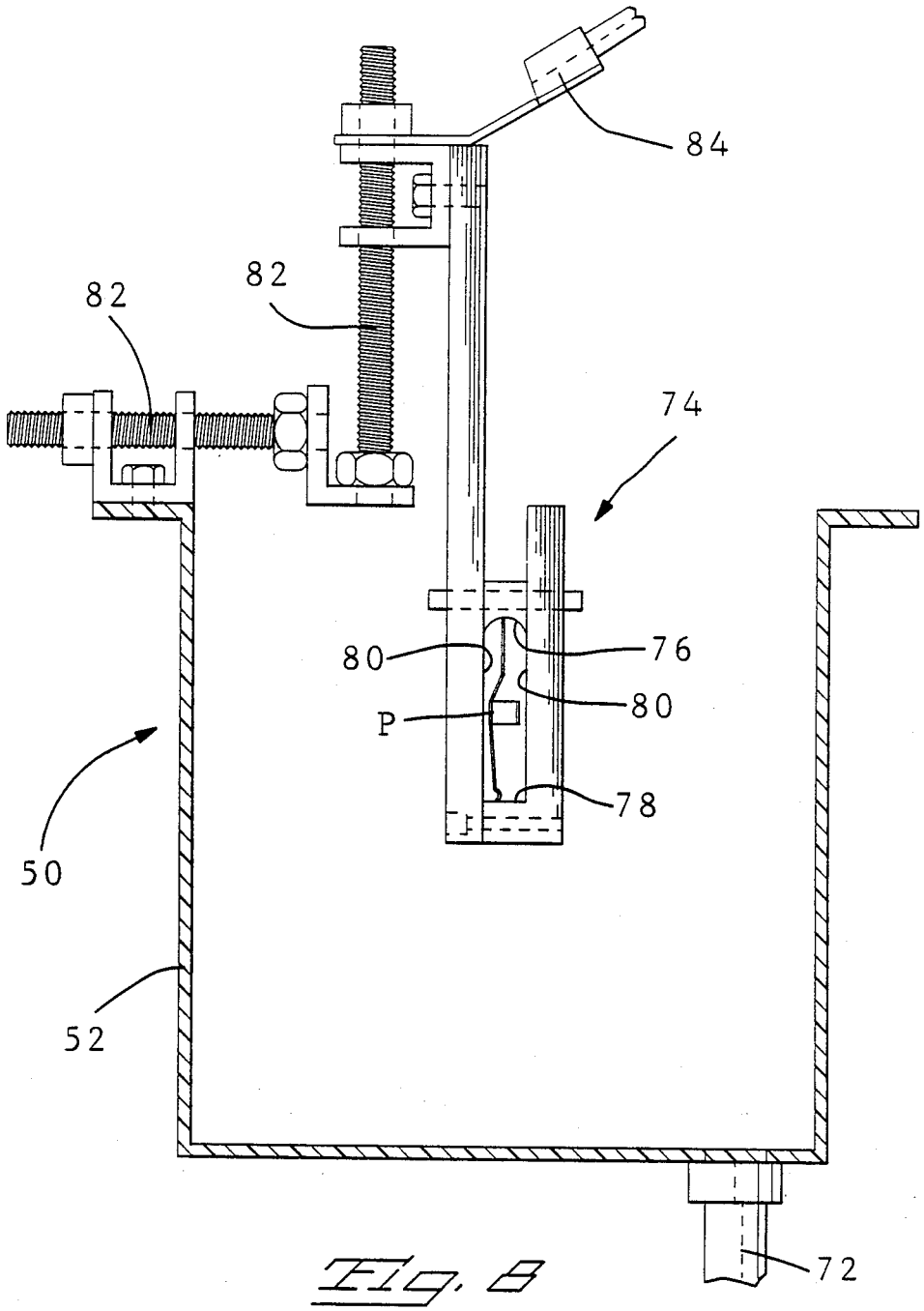
FIG. 8 is a cross sectional view taken along line 8—8 of FIG. 6.

FIG. 8 shows a view of a strip grounding fixture 74 positioned adjacent to the cell 10 in the apparatus 50 of FIG. 6. This grounding fixture 74 is formed of a conductive metal, and defines upper and lower grounding surfaces 76, 78 as well as side grounding surfaces 80. These surfaces 76, 78 are preferably positioned to engage the parts P in sliding contact. The grounding fixture 74 is grounded by a grounding cable 84. The strip grounding fixture 74 is adjustably mounted in place on the trough 52 by means of threaded rods 82.

In operation, the parts P to be plated are guided along the translation axis by the strip guides 62. The grounding fixtures 74 ensure that the parts P are in electrical contact with ground, and the strip guides 62 ensure that the parts wipe across the exposed portion of the sleeve 36 of the brush 30. The anode 34 is connected to a positive voltage source (not shown) by a cable 42.

One important advantage of the brush 30 described above is that the dielectric strip 32 provides structural strength to the brush 30 while physically isolating the part to be plated P from the anode 34. For example, as shown in FIG. 4, the dielectric strip 32 is interposed between the part to be plated P and the anode 34. For this reason, a snag or tear in the sleeve 36 at most allows the part P to come into contact with the dielectric strip 32. The dielectric strip 32 prevents the part P from coming into contact with the anode 34, thereby preventing a short circuit between the grounded part P and the anode 34.

Purely by way of example, the following details are provided in order more clearly to define a preferred mode of use of the cell 10. As before, these details are not intended to be limiting. Preferably, the electroplating apparatus 50 of FIG. 6 is operated with a linear speed of the parts P of about 40 feet per minute and flow rate of plating solution through the slot 22 of each of the cells 10 of about 0.3–0.5 gallons per minute. Any of a wide variety of plating solutions can be used. For example, the gold plating solution supplied by Technique Co. of Providence, R.I. has been found suitable. In this embodiment, the voltage applied to the cable 42 on the anode 34 is in the range of 2.5 to 3.0 VDC and the current is in the range of 0.9–1.0 amp.

Figure 9:
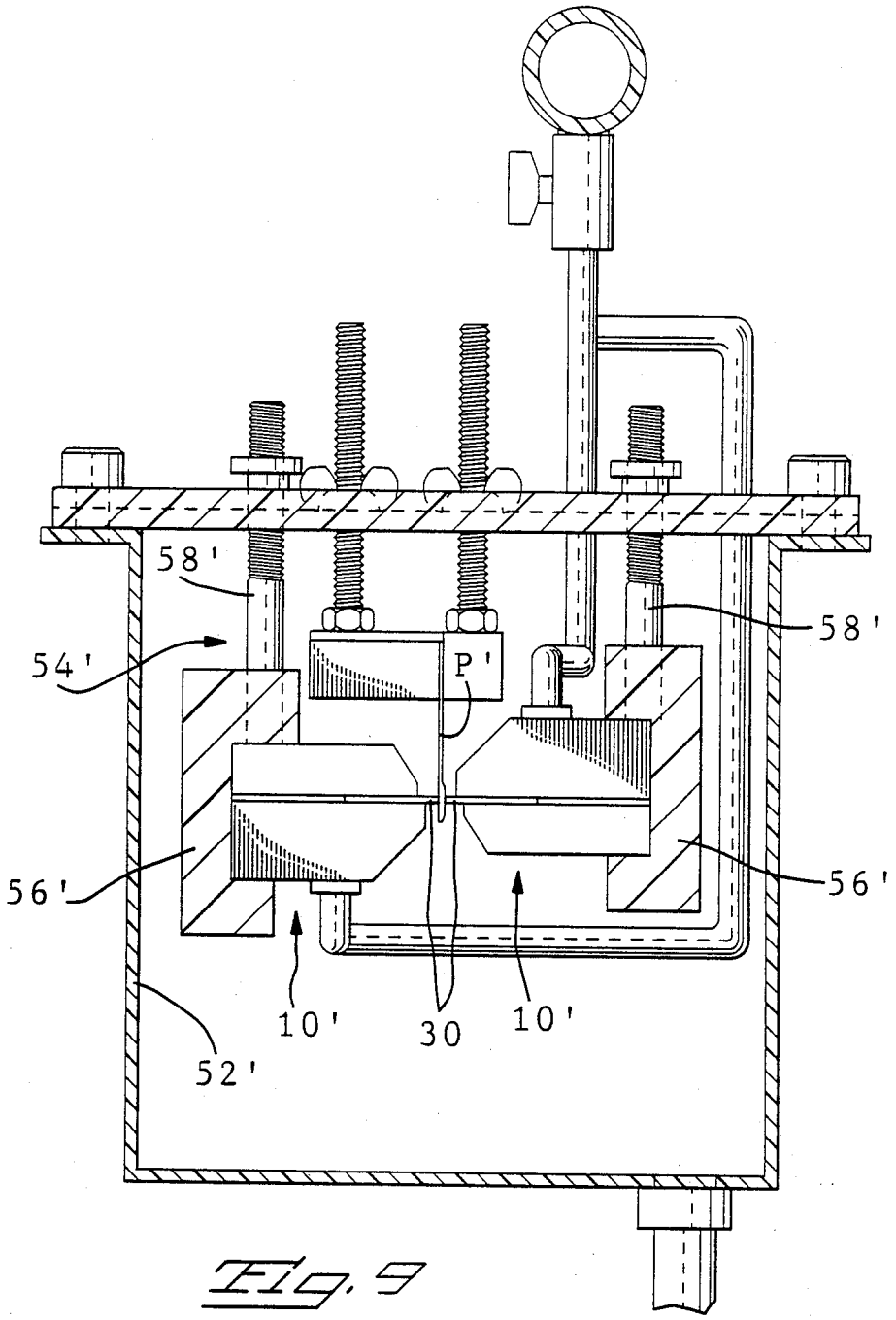
FIG. 9 is a cross sectional view of a second electroplating line which utilizes two of the cells of FIG. 1 in another mode of operation.

Of course, it should be understood that the cell 10 can be used in a wide variety of applications, depending in part upon the configuration of the surface to be plated. FIG. 9 shows one alternative arrangement in which two of the cells 10 are positioned side by side to plate stripes on respective sides of parts P'. These cells 10 are held in place by a cell mounting fixture 54' which includes dielectric blocks 56' that are adjustably held in place by threaded rods 58'. As before, a strip guide 62' is positioned adjacent each of the cells 10 in order to ensure proper positioning of the parts P' with respect to the brushes 30.

Figure 10:
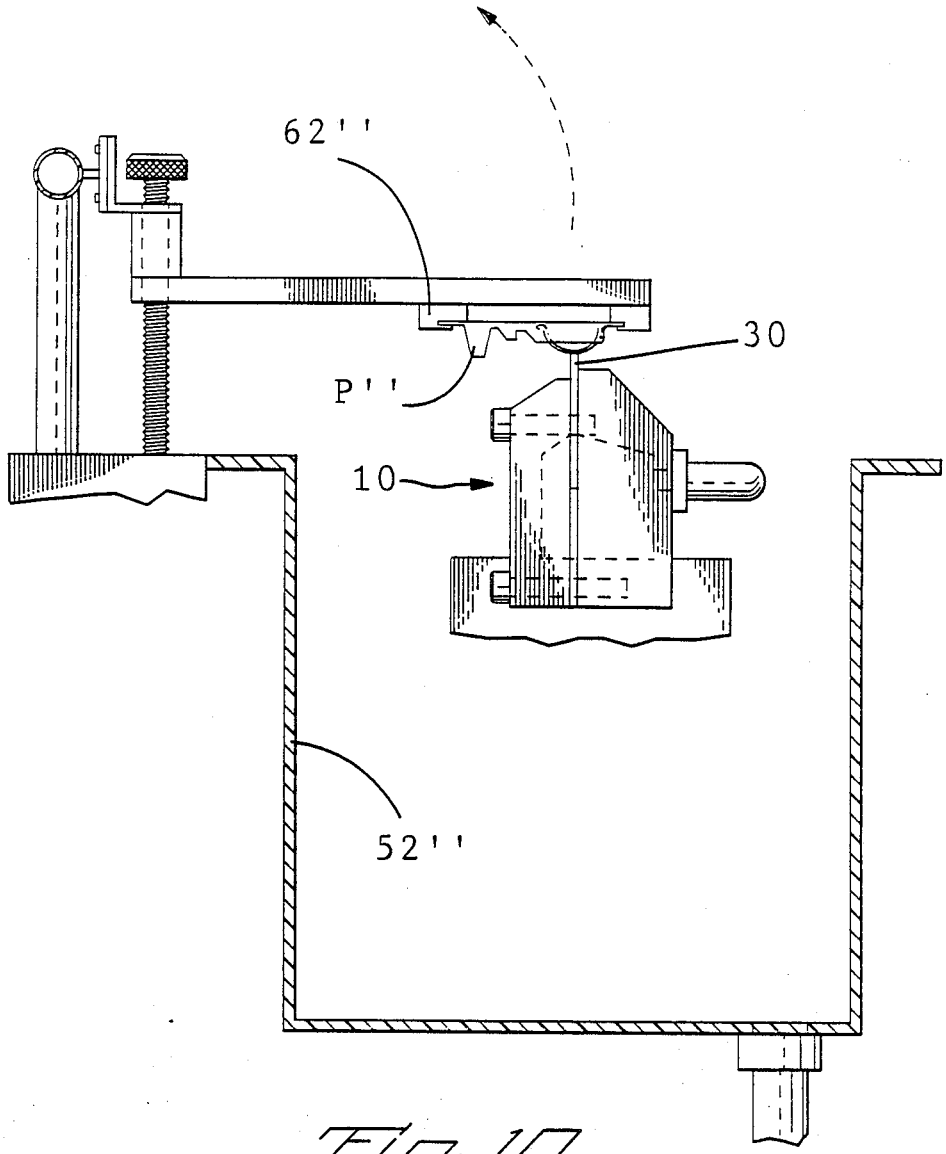
FIG. 10 is a cross sectional view of a third electroplating line which uses the cell of FIG. 1 in a third mode of operation.
Figure 11:
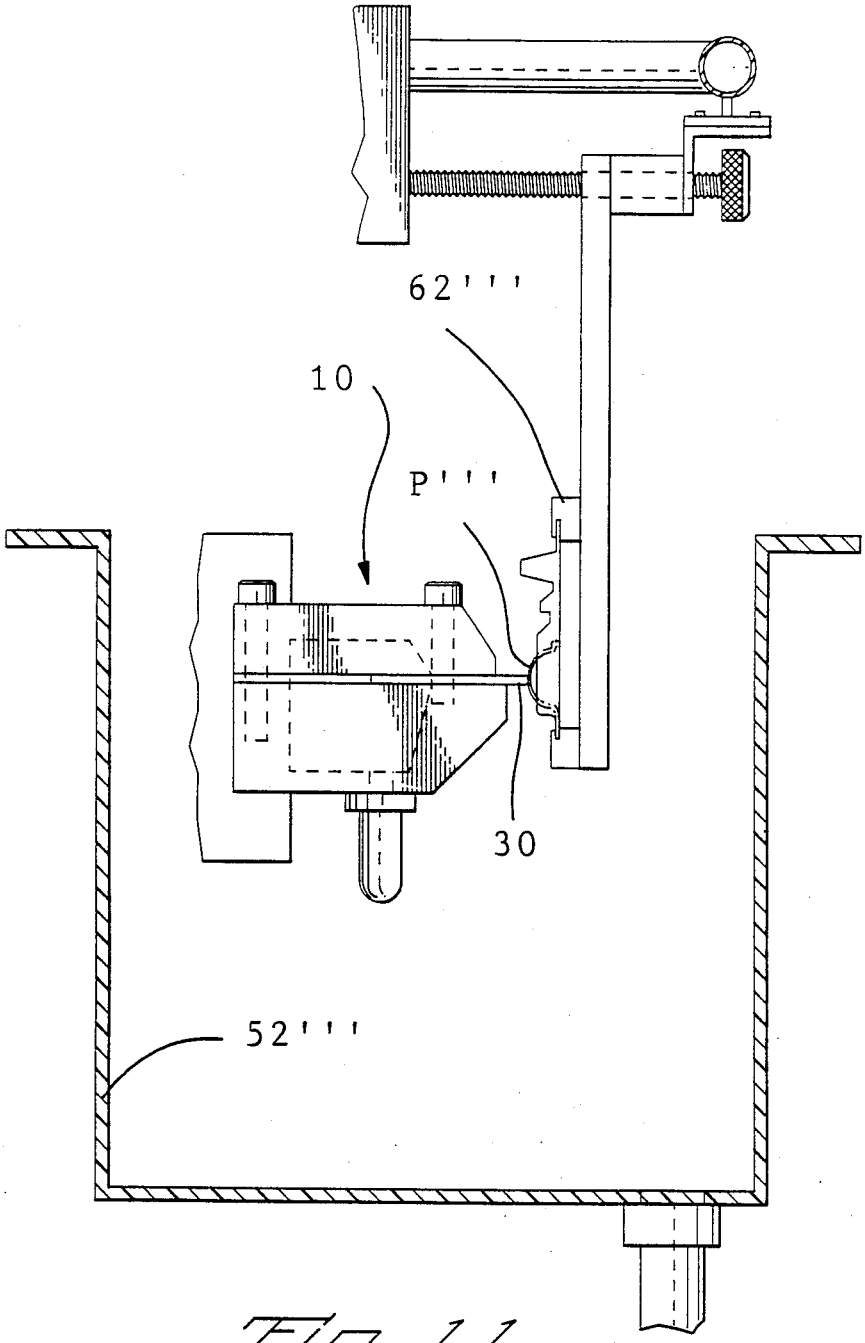
FIG. 11 is a cross sectional view of a fourth electroplating line which uses the cell of FIG. 1 in a fourth mode of operation.

FIGS. 10 and 11 show other applications for the cell 10, in which the end of the brush 30 is used to apply plating solution to the parts P'' and P'''. In both cases the parts P'', P''' are guided by strip guides 62'', 62''' which are mounted on troughs 52'', 52'''.

Of course, it should be understood that a wide range of changes and modifications can be made to the preferred embodiments described above. It is therefore intended that the foregoing detailed description be regarded as illustrative rather than limiting, and that it be understood that it is the following claims, including all equivalents, which are intended to define the scope of this invention.

I claim:

1. An electroplating apparatus for plating only selected regions of parts, said apparatus comprising:

a chamber which defines at least one elongated slot;

means for fixedly mounting the chamber in place such that the slot extends along a translation axis;

means for supplying a plating solution to the chamber;

means for transporting the plating solution through the slot to a region external of the chamber, said transporting means comprising an elongated wick which is fixedly mounted to the chamber to pass through the slot;

an electrode mounted alongside the wick;

means for guiding a plurality of parts to be electroplated for movement along the translation axis past the wick such that plating solution is transferred by the wick from the chamber to the parts; and means for creating a voltage differential between the electrode and the parts.

2. The invention of claim 1 wherein the slot defines an aspect ratio greater than 20:1 as seen from outside the chamber.

3. The invention of claim 1 wherein the slot defines an aspect ratio greater than 100:1 as seen from outside the chamber.

4. The invention of claim 1 wherein the transporting means comprises an insulating support member which extends through the slot;

wherein the wick comprises an absorbent layer which extends through the slot and is positioned between the support member and the parts; and wherein the support member and the absorbent layer are positioned between the electrode and the parts.

5. The invention of claim 4 wherein the absorbent layer is configured as a sleeve which surrounds the support member and the electrode.

6. The invention of claim 4 wherein the support member comprises a dielectric strip.

7. The invention of claim 6 wherein the sleeve is stitched to the dielectric strip to hold the electrode in place on the dielectric strip.

8. The invention of claim 6 wherein the chamber comprises first and second chamber defining elements and a plurality of fasteners for securing the chamber defining elements together, and wherein a plurality of the fasteners pass through the dielectric strip across the slot.

9. An electroplating apparatus comprising:

a chamber which defines an elongated rectilinear slot which extends through a wall of the chamber;

means for fixedly mounting the chamber in place such that the slot is aligned with a translation axis;

means for introducing a plating solution into the chamber;

an elongated plating solution dispenser comprising a dielectric support member, an electrode positioned adjacent to an edge of the support member, and an absorbent sleeve disposed around the support member and the electrode, said dispenser fixed in place in the slot such that at least a first part of the support member and a first part of the sleeve extend outside of the chamber and a second part of the sleeve extends into the chamber to transport plating solution out of the chamber;

means for guiding a plurality of parts to be electroplated along the translation axis with the parts positioned to contact plating solution on the first part of the sleeve, said parts positioned to ensure that the support member is interposed between the electrode and the parts; and means for creating a voltage differential between the electrode and the parts.

10. The invention of claim 9 wherein the dispenser is held in place in the slot by a plurality of fasteners which extend through the dispenser across the slot.

11. The invention of claim 9 wherein the sleeve comprises a fabric.

12. The invention of claim 11 wherein the fabric comprises cotton.

13. The invention of claim 12 wherein the fabric additionally comprises nylon.

14. The invention of claim 9 wherein the electrode comprises platinum.

15. The invention of claim 9 wherein the elongated plating solution dispenser defines an aspect ratio greater than 20:1 as seen from outside the chamber.

16. The invention of claim 9 wherein the elongated plating solution dispenser defines an aspect ratio greater than 100:1 as seen from outside the chamber.

17. A plating brush for applying an electroplating solution to selected portions of parts to be electroplated, said plating brush comprising:

an elongated strip of a dielectric material, said strip defining a longitudinal edge;

an elongated electrode positioned along one side of the elongated strip, adjacent to the longitudinal edge; and a layer of an absorbent fabric positioned around the elongated electrode and at least a portion of the elongated strip adjacent to the longitudinal edge of the elongated electrode.

18. The invention of claim 17 wherein the layer of absorbent fabric defines a sleeve, and wherein the sleeve receives both the elongated strip and the elongated electrode.

19. The invention of claim 17 wherein the absorbent fabric is stitched to the elongated strip to form a pocket sized to receive the elongated electrode and to retain the elongated electrode in place alongside the elongated strip.

* * * * *